US007757961B2

(12) United States Patent
Matsui

(10) Patent No.: US 7,757,961 B2
(45) Date of Patent: Jul. 20, 2010

(54) AIR CONDITIONING SYSTEM

(75) Inventor: Nobuki Matsui, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 425 days.

(21) Appl. No.: 11/920,538

(22) PCT Filed: May 23, 2006

(86) PCT No.: PCT/JP2006/310257

§ 371 (c)(1),
(2), (4) Date: Nov. 16, 2007

(87) PCT Pub. No.: WO2006/126543

PCT Pub. Date: Nov. 30, 2006

(65) Prior Publication Data

US 2009/0134231 A1 May 28, 2009

(30) Foreign Application Priority Data

May 24, 2005 (JP) ..... 2005-151118

(51) Int. Cl.
*G05D 22/02* (2006.01)

(52) U.S. Cl. ..... 236/44 C; 62/158; 62/232

(58) Field of Classification Search ..... 62/158, 62/176.6, 232; 236/44 A, 44 C
See application file for complete search history.

(56) References Cited

U.S. PATENT DOCUMENTS

| | | | | |
|---|---|---|---|---|
| 3,251,196 | A * | 5/1966 | Watkins | 62/158 |
| 3,580,501 | A * | 5/1971 | Streed | 236/44 C |
| 4,807,810 | A * | 2/1989 | Ando | 236/44 A |
| 5,303,562 | A * | 4/1994 | Bahel et al. | 62/222 |
| 5,598,715 | A * | 2/1997 | Edmisten | 62/176.6 |
| 5,743,100 | A * | 4/1998 | Welguisz et al. | 62/158 |
| 5,915,473 | A * | 6/1999 | Ganesh et al. | 165/222 |
| 5,934,084 | A * | 8/1999 | Lee | 62/93 |
| 5,950,442 | A * | 9/1999 | Maeda et al. | 62/175 |
| 6,161,763 | A * | 12/2000 | Reuter | 236/44 C |
| 6,427,461 | B1 * | 8/2002 | Whinery et al. | 62/176.6 |
| 6,874,326 | B2 * | 4/2005 | So et al. | 62/175 |
| 7,386,988 | B1 * | 6/2008 | Petschauer | 62/176.6 |
| 7,472,553 | B2 * | 1/2009 | Ikegami et al. | 62/94 |
| 2007/0138307 | A1 * | 6/2007 | Khoo | 236/1 C |

FOREIGN PATENT DOCUMENTS

| | | |
|---|---|---|
| JP | 2003-106609 A | 4/2003 |
| JP | 2004-294048 A | 10/2004 |

* cited by examiner

*Primary Examiner*—George Nguyen
(74) *Attorney, Agent, or Firm*—Birch, Stewart, Kolasch & Birch, LLP

(57) ABSTRACT

The control means (41 and 42) cause the air conditioner to start air temperature control when temperature To of the outdoor air is in a pre-set range at the time of starting the air conditioning system (1), after the lapse of a pre-set time since the humidity controller (10) started adjusting air humidity. The room temperature nears the humidity set value Rs during the time air temperature control is started in the air conditioner (20).

6 Claims, 7 Drawing Sheets

Second operation

First operation

First air

Second air

First operation

Second operation

AIR CONDITIONING SYSTEM

TECHNICAL FIELD

The present invention relates to an air conditioning system equipped with a humidity controller and an air conditioner for covering the same room space.

BACKGROUND ART

Various space conditioners such as air conditioners for processing a sensible heat load in a room and humidity controllers for processing a latent heat load in a room have hitherto been known.

For example, there is disclosed in Patent Document 1 an air conditioner in which a refrigerant circulates in a refrigerating circuit to perform a cycle of steam compression and refrigeration. To the refrigerating circuit of the air conditioner, a compressor, a room heat exchanger, an expansion valve, an outdoor heat exchanger, and a four-way selector valve are connected. In this air conditioner, the circulating direction of the refrigerant is reversible through switching of the four-way selector valve, and switching between air cooling and heating operation is made possible. In the air cooling operation, air conditioned in the room heat exchanger, which serves as an evaporator, is supplied to the room, thus cooling air of the room. In the heating operation, air heated by the room heat exchanger, which serves as a condenser, is supplied to the room, thus heating the room.

In Patent Document 2, for example, there is disclosed a humidity controller which performs dehumidifying operation for dehumidifying air taken in from outdoors to be supplied to the room and humidifying operation for humidifying air taken in from outdoors to be supplied to the room. This humidity controller is provided with the refrigerating circuit to which is connected an adsorption heat exchanger supporting an adsorbent that performs adsorption of moisture. Specifically, this humidity controller is arranged such that the adsorption heat exchanger functions as the evaporator or the condenser as the circulating direction of the refrigerant switches, thereby enabling the operation to switch between the dehumidifying operation and the humidifying operation. In the dehumidifying operation, the adsorbent is refrigerated by the refrigerant evaporating in the adsorption heat exchanger. Moisture of the air taken in from outdoors, when passing through the adsorption heat exchanger, is adsorbed by this adsorbent while being refrigerated, whereupon the dehumidified and refrigerated air is supplied to the room. In the humidifying operation, the adsorbent is heated by the refrigerant condensed in the adsorption heat exchanger and the moisture adsorbed in the adsorbent is released. The air taken in from outdoors, when passing through the adsorption heat exchanger, is provided with moisture which has desorbed while being heated, whereupon the humidified and heated air is supplied to the room.

[Patent Document 1] Japanese Unexamined Patent Publication No. 2003-106609

[Patent Document 2] Japanese Unexamined Patent Publication No. 2004-294048

PROBLEMS THAT THE INVENTION IS TO SOLVE

As described above, in a humidity controller using an adsorbent, when adjusting air humidity, its temperature is also changed. As a result, when performing room air conditioning with this kind of humidity controller placed side by side an air conditioner, there were following problems when activating the humidity controller and the air conditioner.

For example, in the case where there is relatively a small difference between the outdoor temperature and the room temperature such as in an intermediate period, an air conditioning load is frequently not so large. In such a case, when temperature conditioning of air by the air conditioner and humidity adjustment of air by the humidity controller are simultaneously started, since not only the air conditioner but also the humidity controller is capable of changing air temperature, the room temperature reaches a the set temperature in a relatively short period of time. When the room temperature reaches the set temperature, it becomes necessary to suspend the temperature conditioning of air by the air conditioner and the humidity adjustment of air by the humidity controller so that the room temperature may be maintained at the set temperature. This, however, means that the humidity adjustment of air by the humidity controller is carried out for a short period of time, thus creating a situation where the room temperature may have reached the set temperature while the room humidity may not have reached the set humidity. There was, therefore, a risk of not sufficiently assuring comfort levels for persons staying in the room.

In view of the foregoing, it is the object of the present invention to improve comfort levels of persons in a room space in an air conditioning system which is equipped with a humidity controller and an air conditioner covering the same room space.

DISCLOSURE OF THE INVENTION

A first aspect of the invention is drawn to an air conditioning system (1) provided with a humidity controller (10) for adjusting the humidity of outdoor air and supplying such air to the room, and an air conditioner (20) for supplying temperature-conditioned air to the room. The humidity controller (10) is provided with adsorbing members (51 and 52) by which an adsorbent is supported, and heating source means (50) for heating at least the adsorbent of the adsorbing members (51 and 52), the humidity controller (10) adjusting the humidity of the outdoor air in contact with the adsorbent of the adsorbing members (51 and 52). Further, the air conditioning system is provided with controlling means (41 and 42) for, when temperature To of the outdoor air is within a pre-set range at the time of starting the air conditioning system (1), causing the air conditioner (20) to start air temperature control after a lapse of a pre-set time since the humidity controller (10) started adjusting air humidity.

A second aspect of the invention is drawn to an air conditioning system (1) provided with a humidity controller (10) for adjusting humidity of outdoor air for supply thereof into a room and an air conditioner (20) for supplying into a room air whose temperature is controlled. The humidity controller (10) is provided with a refrigerant circuit (50) to which adsorbing heat exchangers (51 and 52) with an adsorbent supported thereon are connected, thus carrying out a refrigerating cycle, the humidity controller (10) adjusting the humidity of the outdoor air in contact with the adsorbent by heating or refrigerating the adsorbent of the adsorbing heat exchangers (51 and 52) through the refrigerant of the refrigerant circuit (50). Further, the air conditioning system (1) is provided with a controlling means (41 and 42) for, when a temperature To of the outdoor air is within a pre-set range at the time of starting the air conditioning system (1), causing the air conditioner (20) to start air temperature control after a lapse of a pre-set time since the humidity controller (10) started adjusting air humidity.

According to a third aspect of the invention, in the first or the second aspect of the invention, the air conditioner (20) is capable of selecting between a cooling operating mode for cooling the room and a heating operating mode for heating the room. At the time of causing the air conditioner (20) to start air temperature control after the lapse of the pre-set time since the humidity controller (10) started air humidity adjustment, the control means (41 and 42) perform a decision-making action to determine an operating mode of the air conditioner (20) on the basis of a set value Ts and a measured value of the room temperature.

According to a fourth aspect of the invention, in the third aspect of the invention, in the decision-making action, the control means (41 and 42) determine the operating mode of the air conditioner (20) on the basis of a changed value of a difference between the set value Ts and the measured value of the room temperature from the start of the air humidity adjustment by the humidity controller (10) to the start of the air temperature control by the air conditioner (20).

According to a fifth aspect of the invention, in the third or the fourth aspect of the invention, the control means (41 and 42) are configured to: set up the air conditioner (20) at a thermostat-off status to stop the air temperature control in cases where the measured value of the room temperature falls below the set value Ts during the air cooling and where the measured value of the room temperature increases above the set value Ts during the heating operation; and to, after the lapse of a pre-set time from the start of the thermostat-off status, determine the operating mode of the air conditioner (20) on the basis of the set value Ts and the measured value of the room temperature.

According to a sixth aspect of the invention, in the third or the fourth aspect of the invention, the control means (41 and 42) are configured to: set up the air conditioner (20) in a thermostat-off status to stop the air temperature control in cases where the measured value of the room temperature falls below the set value Ts during the air cooling and where the measured value of the room temperature increase above the set value Ts during the heating operation; and to cause, if the difference between the set value Ts and the measured value of the room temperature should increase during a period of time from a certain point in time in the thermostat-off status until a lapse of a pre-set time, the air conditioner (20) to operate on an operating mode different from the operating mode immediately before entering the thermostat-off status.

Operation

In the first aspect of the invention, the humidity of the outdoor air is adjusted by coming into contact with the adsorbent of the adsorbing members (51 and 52), whereupon not only the amount of the moisture in the outdoor air but also its temperature undergoes change. When the temperature To of the outdoor air is within the preset range, for a while after starting the air conditioning system (1), the outdoor air subjected to humidity adjustment by the humidity controller (10) is supplied to the room. During that time, the room humidity comes very close to the set humidity. As operation of the humidity controller (10) is carried out for a pre-set period of time, the room humidity reaches a state in the vicinity of the humidity setting, where the control means (41 and 42) start adjusting the temperature of air by the air conditioner (20).

In the second aspect of the invention, the refrigerant circulating in the refrigerant circuit (50) heats or refrigerates the adsorbent of the adsorption heat exchangers (51 and 52). Specifically, in the adsorption heat exchangers (51 and 52) serving as the condensers, the adsorbent on the surface thereof is heated by the refrigerant. Air passing through these adsorption heat exchangers (51 and 52) is humidified by moisture which is desorbed from the adsorbent, while, at the same time, being heated by the refrigerant. Further, in the adsorption heat exchangers (51 and 52) serving as the evaporators, the adsorbent on the surface thereof is refrigerated by the refrigerant. Air passing through these adsorption heat exchangers (51 and 52) is dehumidified as moisture is removed by the refrigerant, while, at same time, being refrigerated by the refrigerant. In this manner, not only humidity but also temperature of the air passing through these adsorption heat exchangers (51 and 52) undergoes change.

In the second aspect of the invention, when the temperature To of the outdoor air is within the preset range, for a while after starting the air conditioning system (1), the outdoor air subjected to humidity adjustment by the humidity controller (10) is supplied to the room. During that time, the room humidity comes very close to the set humidity. As operation of the humidity controller (10) is carried out for the pre-set period of time, the room humidity reaches a state in the vicinity of the humidity setting, where the control means (41 and 42) start conditioning air temperature by the air conditioner (20).

In the third aspect of the invention, at the time of causing the air conditioner (20) to start conditioning air temperature after the lapse of a pre-set time from the start of adjusting air humidity by the humidity controller (10), the control means (41 and 42) perform the decision-making action to determine the operating mode of the air conditioner (20). The decision-making action is based on the set value Ts and the measured value of the room temperature. This allows proper determination of the operating mode of the air conditioner (20).

In the fourth aspect of the invention, the decision-making action is carried out on the basis of a changed value which is a difference between the set value Ts and the measured value of the room temperature from the start of air humidity by the humidity controller (10) to the start of conditioning air temperature by the air conditioner (20). This changed value represents a ratio by which the room temperature increases or decreases due to the operation of the humidity controller (10). That is, in the fourth aspect of the invention, by taking into consideration how the room temperature is affected by the operation of the humidity controller (10), the operating mode of the air conditioner (20) is determined.

In the fifth aspect of the invention, when the pre-set time passes from the start of the thermostat-off status, the control means (41 and 42) determine the operating mode of the air conditioner (20) on the basis of the set value Ts and the measured value of the room temperature. At this point, depending on the timing where the air conditioner (20) turns into the thermostat-off status, there may be a case where the difference between the room temperature and the set value Ts immediately after entering the thermostat-off status may become relatively large. Further, in the air conditioning system (1), the humidity controller (10) has the capacity to change the room temperature, hence, the room temperature may be maintained at a condition relatively apart from the set value Ts. Still further, that the air conditioner (20) has reached the thermostat-off status indicates a possibility that the capacity of the air conditioner (20) prior to reaching the thermostat-off status was too large. Consequently, when the thermostat-off status is simply cancelled, there is a risk that the subsequent room temperature may draw apart from the set value Ts. Accordingly, in the fifth aspect of the invention, to avoid falling into such a state, after the elapse of a pre-set time from the start of the thermostat-off status, the operating mode of the air conditioner (20) is determined.

In the sixth aspect of the invention, when the difference between the set value Ts and the measured value of the room temperature in the thermostat-off status tends to increase, the air conditioner (20) is caused to operate on an operating mode different from the operating mode immediately before reaching the thermostat-off status. Since the humidity controller (10) has capacity to change the room temperature in this air conditioning system (1), there may be a case where the room temperature may draw apart from the set value Ts even in the thermostat-off status. Furthermore, when the thermostat-off status is simply cancelled, there is a risk that the subsequent room temperature may draw apart more and more from the set value Ts. In view of this, in the sixth aspect of the invention, to avoid falling into such a state, the air conditioner (20) is caused to operate on an operating mode different from the operating mode immediately before reaching the thermostat-off status.

EFFECTS OF THE INVENTION

In the present invention, when the temperature To of the outdoor air is within the pre-set range, it is configured such that humidity adjustment of air by the humidity controller (10) is started in advance of air temperature conditioning by the air conditioner (20) so as to secure time for humidity adjustment of air by the humidity controller (10). This allows for starting of air temperature conditioning by the air conditioner (20) at a condition where the room humidity is in the vicinity of the humidity set value Rs. At this point, should the humidity adjustment by the humidity controller (10) and the air temperature conditioning by the air conditioner (20) simultaneously start, the room temperature reaches the set value Ts in a relatively short period of time, so that even despite insufficient humidity adjustment, operation of the humidity controller (10) may be limited in some cases. In this invention, however, when the temperature To of the outdoor air is within the pre-set range, humidity adjustment of air is carried out by the humidity controller (10) until air temperature conditioning by the air conditioner (20) starts, making it possible to bring the room humidity in the vicinity of the humidity set value Rs. This improves comfort levels of the person in the room space.

Further, in the above-mentioned third aspect of the invention, when the air conditioner (20) is caused to start air temperature conditioning after the lapse of a pre-set time from the start of adjusting air humidity by the humidity controller (10), by determining the operating mode of the air conditioner (20) on the basis of the set value Ts and the measured value of the room temperature, the operating mode is designed to be properly evaluate. Thus, when air temperature conditioning by the air conditioner (20) is started on the determined operating mode, the room temperature comes very close to the set value Ts, thereby improving the comfort levels of the person in the room.

Further, in the above-mentioned fourth aspect of the invention, by using the changed value which is a difference between the set value Ts and the measured value of the room temperature from the start of adjusting air humidity by the humidity controller (10) to the start of air temperature conditioning by the air conditioner (20) for the above-mentioned decision-making action, the operating mode of the air conditioner (20) is determined while taking into consideration changes in the room temperature due to the operation of the humidity controller (10). This makes it possible to determine accurately whether to cool or to heat the room when starting air temperature conditioning by the air conditioner (20), thus properly determining the operating mode of the air conditioner (20).

Further, according to the above-mentioned fifth aspect of the invention, in this air conditioning system (1), there are cases where even if the air conditioner (20) is in the thermostat-off status, the room temperature may be maintained at a condition where the difference with the set value Ts is relatively large. In view of this, after the lapse of a pre-set time from the start of the thermostat-off status, it is configured that the above-mentioned control means (41 and 42) determine the operating mode of the air conditioner (20). Furthermore, the operating mode of the air conditioner (20) is determined properly for the room temperature to move very close to the temperature set value Ts. Thus, the time for the room temperature to be in the vicinity of the set value Ts is made long, thereby improving the comfort levels of the person in the room space.

Moreover, according to the above-mentioned sixth aspect of the invention, in some cases, this air conditioning system (1) is such that even if the air conditioner (20) is in the thermostat-off status, the room temperature may move away from the set value Ts. Upon detecting such condition, the air conditioner (20) is configured to operate on a different operating mode from the operating mode immediately before entering the thermostat-off status. This causes the room temperature to move to the vicinity of the set value Ts and leads to improvement in the comfort levels of the person in the room space.

REFERENCE NUMERAL

1 Air conditioning system
10 Humidity controller
20 Air conditioner
41 Air conditioning section (control means)
42 Humidity adjustment section (control means)
50 Refrigerating circuit (heat source means)
51 First adsorption heat exchanger (adsorption member, adsorption heat exchanger)

52 Second adsorption heat exchanger (adsorption member, adsorption heat exchanger)

BEST MODE FOR CARRYING OUT THE INVENTION

Figure 1:
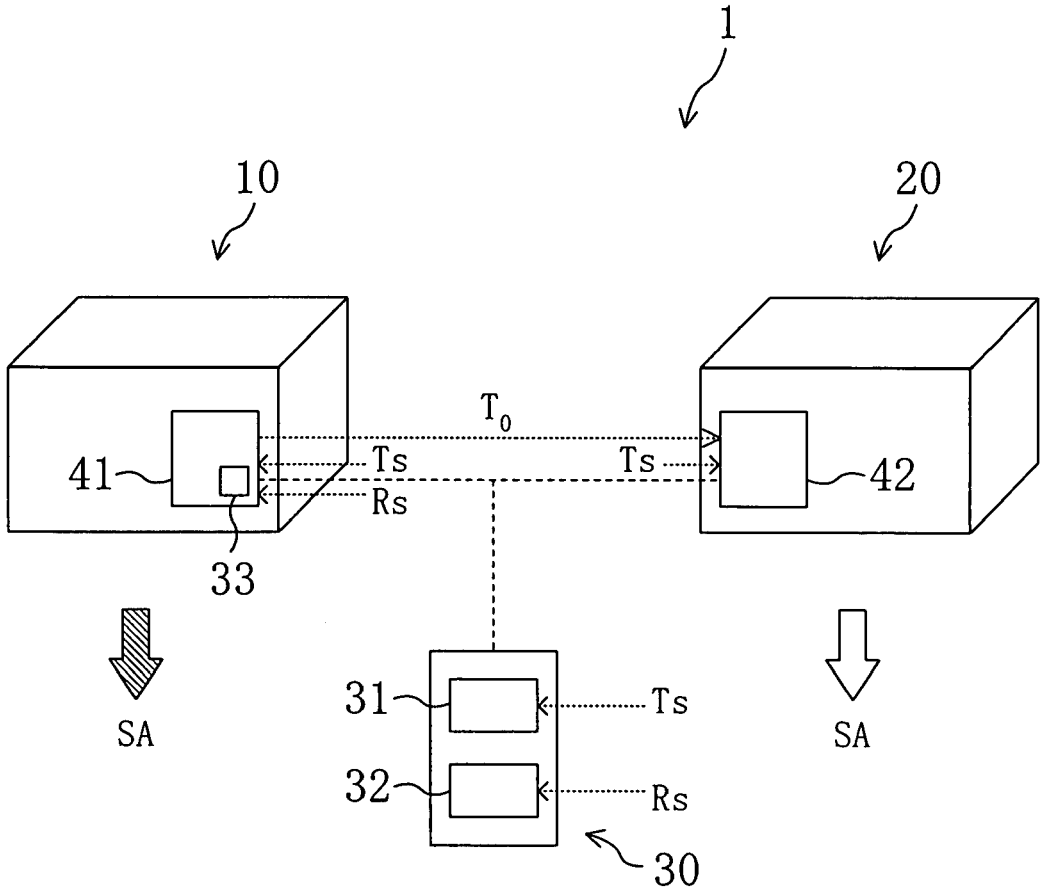
FIG. 1 is a schematic block diagram of an air conditioning system which represents an embodiment.

Embodiments of the present invention will be described. As shown in FIG. 1, an air conditioning system (1) of this embodiment has a humidity controller (10) and an air conditioner (20) that are arranged to cover the same room space, and a controller (30). A humidity adjustment section (41) is provided in the humidity controller (10), while an air conditioning section (42) is provided in the air conditioner (20). In addition, a temperature setting section (31) and a humidity setting section (32) are provided in the controller (30). The humidity adjustment section (41) and the air conditioning control section (42) constitute control means according to the present invention. Details on the humidity adjustment section (41), the air conditioning control section (42), and the controller (30) will be provided later.

<Schematic Configuration of the Humidity Controller>

The humidity controller (10) of this embodiment is so configured as to enable dehumidifying operation to dehumidify outdoor air (OA) taken in and supply such air to the room, and humidifying operation to humidify outdoor air (OA) taken in and supply such air to the room.

As shown in FIG. 2, the humidity controller (10) is provided with a refrigerant circuit (50) which is heat source means. This refrigerant circuit (50) is a closed circuit provided with a first adsorption heat exchanger (51) and a second adsorption heat exchanger (52) which are adsorption members, a compressor (53), a four-way selector valve (54), and a motorized expansion valve (55). This refrigerant circuit (50) performs a steam compression refrigerating cycle by circulating the filled refrigerant.

In the above refrigerant circuit (50), an ejection side of the compressor (53) is linked to a first port of the four-way selector valve (54), while a suction side of the compressor (53) is linked to a second port of the four-way selector valve (54). One end of the first adsorption heat exchanger (51) is linked to a third port of the four-way selector valve (54). The other end of the first adsorption heat exchanger (51) is linked via the motorized expansion valve (55) to one end of the second adsorption heat exchanger (52). The other end of the second adsorption heat exchanger (52) is linked to a fourth port of the four-way selector valve (54).

The above four-way selector valve (54) is capable of implementing switching between the first condition (condition shown in FIG. 2 (A)), where the first port and the third port are in communication while the second port and the fourth port are in communication, and the second condition (condition shown in FIG. 2 (B)), where the first port and the fourth port are in communication while the second port and the third port are in communication.

Figure 3:
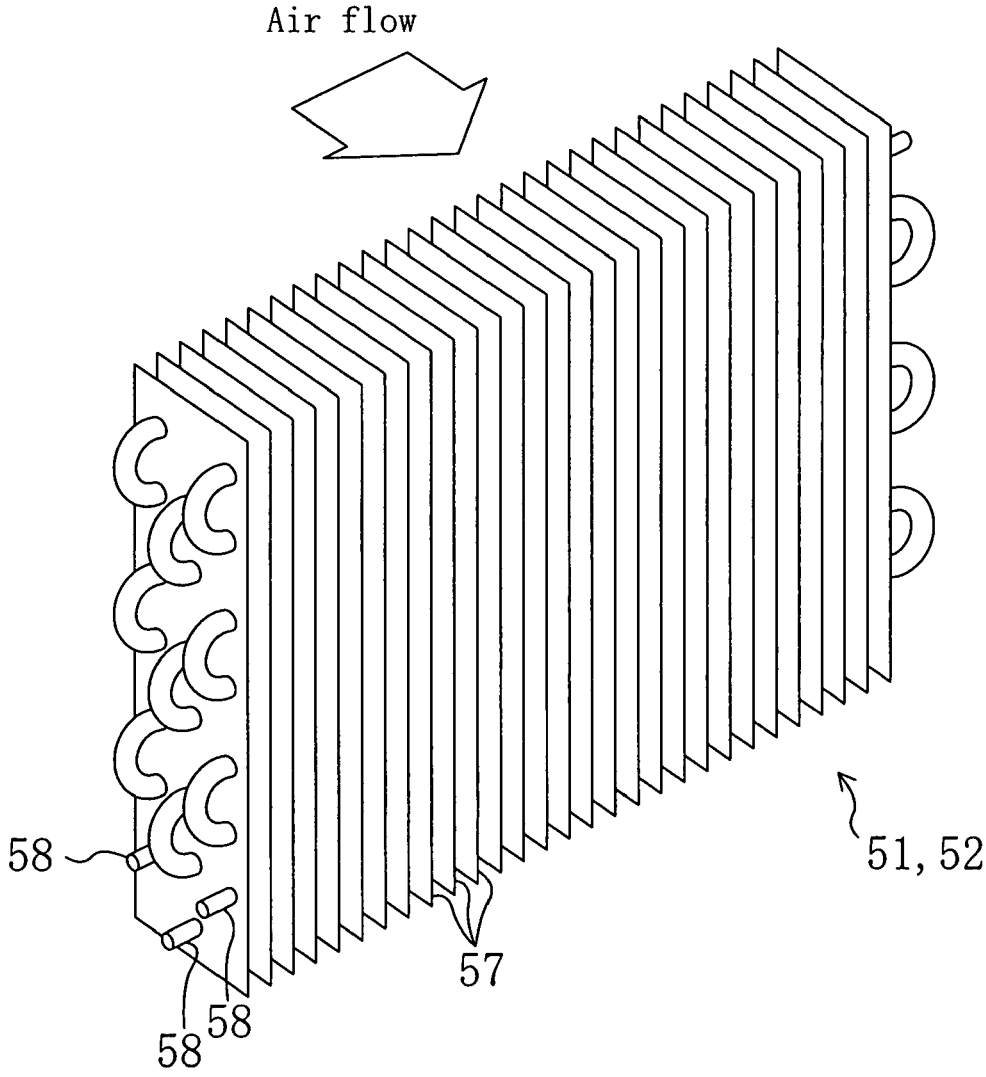
FIG. 3 is a schematic perspective view of an adsorption heat exchanger.

As shown in FIG. 3, the first adsorption heat exchanger (51) and the second adsorption heat exchanger (52) are both constituted of a fin and tube heat exchanger of the cross fin type. These adsorption heat exchangers (51 and 52) are provided with copper heat transfer tubes (58) and aluminum-made fins (57). A plurality of fins (57) set up on the adsorption heat exchangers (51 and 52) are respectively formed in an oblong plate shape and arranged at a preset spacing. Further, the heat transfer pipes (58) are provided to pierce through the fins (57).

In each of the above-mentioned adsorption heat exchangers (51 and 52), the adsorbent is supported on the surface of each fin (57), so that air passing through the fins (57) comes into contact with the adsorbent on the surface of the fins (57). As the adsorbent, there are employed those materials which can adsorb moisture vapor in air such as zeolite, silica gel, activated charcoal, and any other organic high-molecule material having a hydrophilic functional group.

Further, the humidity controller (10) is provided with a plurality of sensors, not shown, for measuring air temperature and humidity. These plurality of sensors are constituted of an outdoor temperature sensor measuring the temperature of outdoor air (OA) which is directed from outdoors into the humidity controller (10), an outdoor humidity sensor measuring the relative humidity of the outdoor air (OA), a room temperature sensor measuring the temperature of room air (RA) in the room to which is supplied air whose humidity has been adjusted by the humidity controller (10), and a room humidity sensor measuring the relative humidity of that room air (RA). The measured values of these temperature sensors are transmitted to the humidity adjustment section (41).

<Schematic Configuration of the Air Conditioner>

The air conditioner (20) of this embodiment is so configured as to be able to select the operating mode between an air cooling to supply air conditioned air to the room and a heating operation to supply heated air to the room.

As shown in FIG. 4, the above-mentioned air conditioner (20) has a room unit (21) and an outdoor unit (22). The room unit (21) is arranged in the room, and a room heat exchanger (62) is housed in this room unit (21). On the other hand, the above-mentioned outdoor unit (22) is arranged outdoors. This outdoor unit (22) houses an outdoor heat exchanger (61), a compressor (63), a four-way selector valve (64), and a motorized expansion valve (65). The above-mentioned room unit (21) and the above-mentioned outdoor unit (22) are mutually linked by two connecting pipes (23 and 24). This air conditioner (20) is constituted of a refrigerant circuit (60) which is a closed circuit. This refrigerant circuit (60) performs a steam-pressure compression freezing cycle by circulating filled refrigerant. Although not shown, a room fan is set up in the room unit, while an outdoor fan is set up in the outdoor unit.

In the above-mentioned refrigerant circuit (60), an ejection side of the compressor (63) is linked to a first port of the four-way selector valve (64) while a suction side the compressor (63) is linked to a second port of the four-way selector valve (64). One end of the outdoor heat exchanger (61) is linked to a third port of the four-way selector valve (64), while the other end of the outdoor heat exchanger (61) is linked via the motorized expansion valve (65) to one end of the room heat exchanger (62). The other end of the room heat exchanger (62) is linked to a fourth port of the four-way selector valve (64).

Figure 4B:
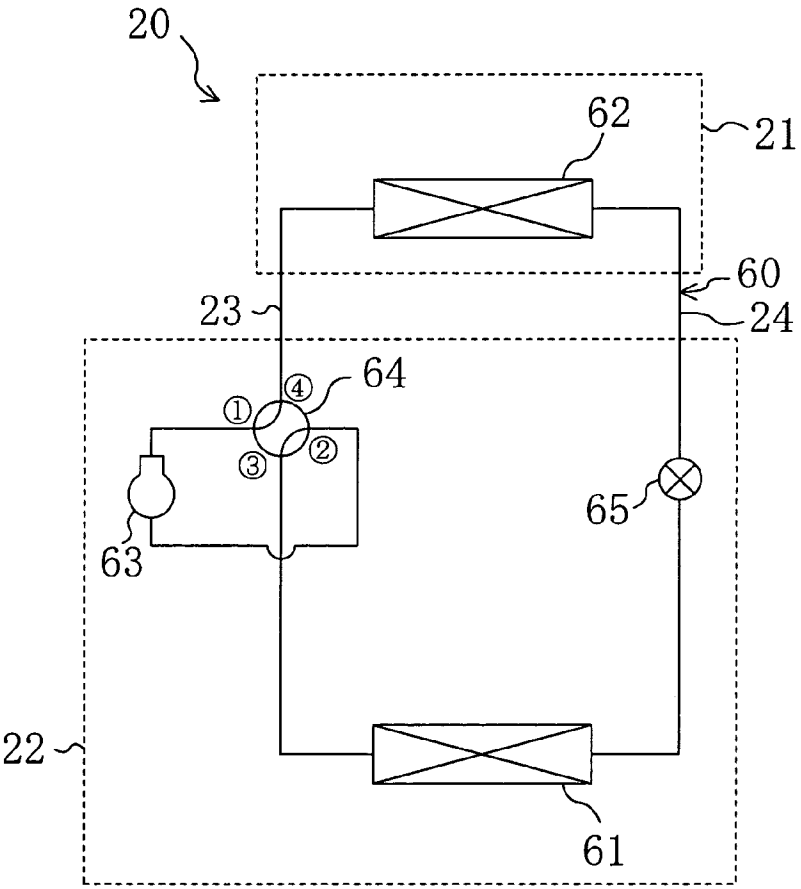
FIG. 4 is a piping system diagram showing construction of a refrigerant circuit of an air conditioner of an embodiment; (A) shows a first condition, and (B) shows a second condition.
Figure 4A:
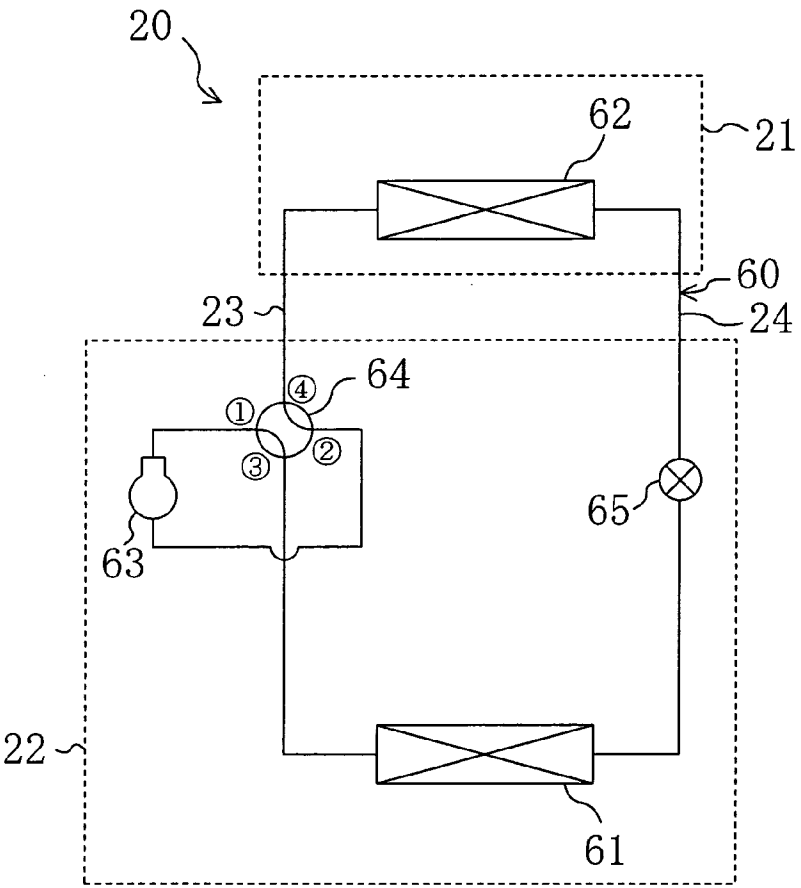

The above-mentioned four-way selector valve (64) is such that a first condition (condition shown in FIG. 4(A)) in which the first port and the third port are in communication while the second port and the fourth port are in communication can be switched to a second condition (condition shown in FIG. 4(B)) in which the first port and the fourth port are in communication while the second port and the third port are in communication. Further, the air conditioner (20) is provided with a suction temperature sensor for measuring the temperature of air to be sucked into the air conditioner (20). This suction temperature sensor measures the temperature of the room air (RA) similarly to the room temperature sensor of the humidity controller (10). The measured values of this suction temperature sensor are transmitted to the air conditioning control section (42).

<Configuration of the Humidity Adjustment Section, the Air Conditioning Control Section, and the Controller>

As described above, the controller (30), the humidity adjustment section (41), and the air conditioning control section (42) are provided in the air conditioning system (1) of this embodiment.

The above-mentioned controller (30) is constituted of an input section to input the temperature set value Ts which becomes a control target of the air conditioner (20) and the humidity set value Rs which becomes a control target of the humidity controller (10). The controller (30) is such that the target temperature Ts is inputted into the temperature setting section (31) as the desired room temperature, while the target humidity Rs is inputted into the humidity setting section (32) as the desired room humidity. Specifically, the humidity set value Rs to be inputted into the humidity setting section (32) is selectively inputted from among three levels: "Low", "Medium", and "High". The inputted humidity set value Rs is set in the humidity setting section (32) as a relative humidity. The humidity setting section (32) has pre-set therein values or ranges of relative humidity respectively corresponding to "Low", "Medium", and "High".

The air conditioning control section (42) and the humidity adjustment section (41) are configured to be directly communicable to each other. Specifically, the air conditioning system (1) is so configured that the measured value To of the outdoor temperature sensor is transmitted from the humidity adjustment section (41) to the air conditioning control section (42) upon starting of the air conditioning system (1).

The above-mentioned air conditioning control section (42) receives the temperature set value Ts, which is inputted to the controller (30), and the measured value of the suction temperature sensor, and the measured value To of the outdoor temperature sensor transmitted from the humidity controller (10). This air conditioning control section (42) adjusts the temperature adjusting capacity of the air conditioner (20) to cause the room temperature to come very close to the above-mentioned temperature set value Ts. Further, at the time of humidifying operation and dehumidifying operation described later, when the measured value To of the outdoor temperature sensor is within a pre-set range in relation to the temperature set value Ts, then the air conditioning control section (42) starts the air conditioner (20) after the lapse of a pre-set time (e.g., 15 minutes) from the start of the humidity controller (10), and further, when starting the air conditioner (20), carries out a decision-making action to determine the operating mode of that air conditioner (20) on the basis of the temperature set value Ts and the measured value of the suction temperature sensor. Furthermore, the air conditioning control section (42) determines the operating mode of the air conditioner (20) when pre-set conditions are established in the thermostat-off status, described later. Details of the operation of the air conditioning control section (42) will be described later.

The above-mentioned humidity adjustment section (41) receives the temperature set value Ts and the humidity set value Rs, which are inputted into the controller (30), the measured value To of the outdoor temperature sensor, the measured value of the outdoor humidity sensor, the measured value of the room temperature sensor, and the measured value of the room humidity sensor. This humidity adjustment section (41) adjusts the humidity adjusting capacity of the humidity controller (10) to cause the relative humidity of the room to come very close to the humidity set value Rs. Specifically, this humidity adjustment section (41) is provided with an arithmetic section (33), which calculates an absolute humidity that corresponds to the conditions of the temperature set value Ts and the humidity set value Rs received by the humidity adjustment section (41). Further, the humidity adjustment section (41) sets such calculated absolute humidity as the target absolute humidity and adjusts the humidity adjusting capacity of the humidity controller (10) to cause the absolute humidity of the room to come very close to the target absolute humidity. Details of the operation of the humidity adjustment section (41) will be described later.

It is possible that without providing the suction temperature sensor in the air conditioner (20), the measured value of the room temperature of the humidity controller (10) is transmitted from the humidity adjustment section (41) to the air conditioning control section (42) to be used in lieu of the measured value of the suction temperature sensor. It is also possible that conversely, without providing the room temperature sensor in the humidity controller (10), the measured value of the suction temperature sensor of the air conditioner (20) is transmitted from the air conditioning control section (42) to the humidity adjustment section (41) to be used in lieu of the measured value of the room temperature sensor.

Operation

<Operation of the Humidity Controller>

In the humidity controller (10) of this embodiment, the dehumidifying operation and the humidifying operation are performed. When in the dehumidifying operation and the humidifying operation, the humidity controller (10) subjects taken-in outdoor air to humidity adjustment, then supplies such air as supply air (SA) to the room, while, at the same time, ejecting the taken-in room air (RA) as ejected air (EA). Namely, the humidity controller (10) in the dehumidifying operation and the humidifying operation performs air ventilation. Further, the humidity controller (10) alternately repeats the first operation and the second operation at preset time intervals (e.g., 3-minute intervals) during either the dehumidifying operation or the humidifying operation.

The humidity controller (10) takes in, during the dehumidifying operation, outdoor air (OA) as the first air and room air (RA) as the second air. Further, the humidity controller (10) takes in, during the humidifying operation, room air (RA) as the first air and outdoor air (OA) as the second air.

First, the first operation will be described. During the first operation, the second air is sent to the first adsorption heat exchanger (51) and the first air is sent to the second adsorption heat exchanger (52). In this first operation, regenerating action is performed regarding the first adsorption heat exchanger (51) and adsorption action is performed regarding the second adsorption heat exchanger (52).

Figure 2B:
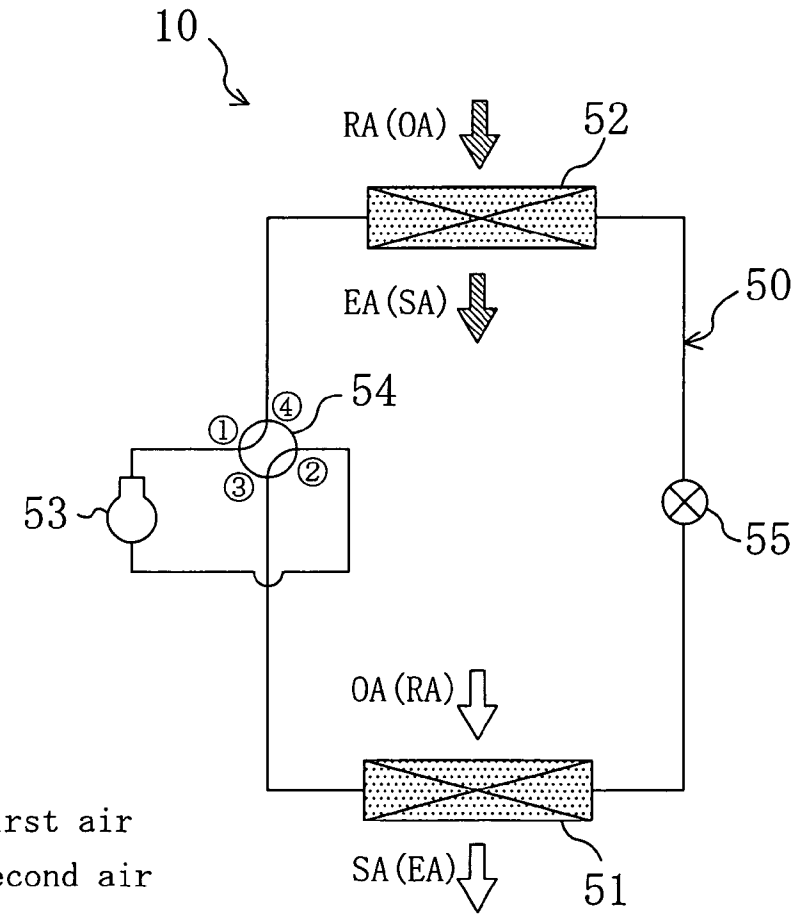
FIG. 2 is a piping system diagram showing construction of a refrigerant circuit of a humidity controller of an embodiment; (A) shows operation during a first operation, and (B) shows operation during a second operation.
Figure 2A:
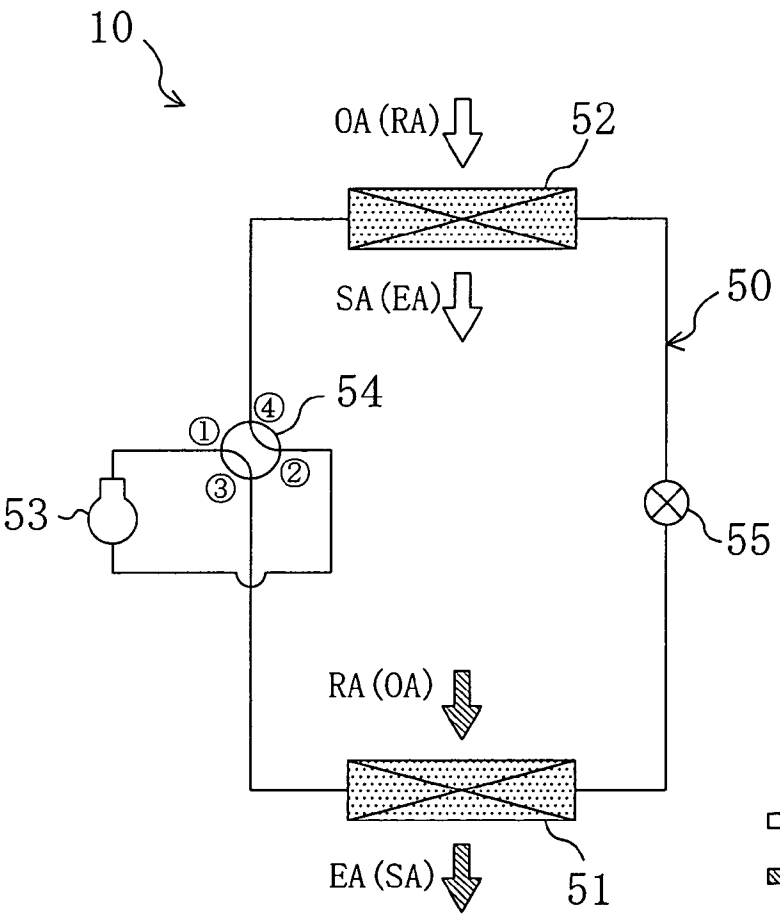

As shown in FIG. 2(A), in the refrigerant circuit (50) during the first operation, the four-way selector valve (54) is set in the first condition. When the compressor (53) is operated, the refrigerant circulates in the refrigerant circuit (50). Specifically, the refrigerant ejected from the compressor (53) releases heat in the first adsorption heat exchanger (51) to be condensed. The refrigerant condensed in the first adsorption heat exchanger (51) is depressurized when passing through the motorized expansion valve (55), thereafter absorbing heat in the second adsorption heat exchanger (52) to be evaporated. The refrigerant evaporated in the second adsorption heat exchanger (52) is sucked into the compressor (53) and compressed, and again ejected from the compressor (53).

In this manner, in the refrigerant circuit (50) during the first operation, the first adsorption heat exchanger (51) operates as the condenser, while the second adsorption heat exchanger (52) operates as the evaporator. In the first adsorption heat exchanger (51), the adsorbent on the surfaces of the fins (57) is heated by the refrigerant in the heat transfer pipe (58), so that moisture desorbed from the heated adsorbent is provided to the second air. On the other hand, in the second adsorption heat exchanger (52), moisture in the first air is adsorbed by the adsorbent on the surfaces of the fins (57), and the generated adsorption heat is absorbed by the refrigerant in the heat transfer pipe (58).

Then, if during the dehumidifying operation, the first air dehumidified by the second adsorption heat exchanger (52) is supplied to the room, while the moisture desorbed from the first adsorption heat exchanger (51) is ejected outdoors together with the second air. On the other hand, if during the humidifying operation, the second air humidified by the first adsorption heat exchanger (51) is supplied to the room, while the first air deprived of moisture in the second adsorption heat exchanger (52) is ejected outdoors.

Next, the second operation will be described. During the second operation, the first air is sent to the first adsorption heat exchanger (51) and the second air is sent to the second adsorption heat exchanger (52). In this second operation, regenerating action is performed regarding the second adsorption heat exchanger (52) and adsorption action is performed regarding the first adsorption heat exchanger (51).

As shown in FIG. 2(B), in the refrigerant circuit (50) during the second operation, the four-way selector valve (54) is set in the second condition. When the compressor (53) is operated, the refrigerant circulates in the refrigerant circuit (50). Specifically, the refrigerant ejected from the compressor (53) releases heat in the second adsorption heat exchanger (52) to be condensed. The refrigerant condensed in the second adsorption heat exchanger (52) is depressurized when passing through the motorized expansion valve (55), thereafter absorbing heat in the first adsorption heat exchanger (51) to be evaporated. The refrigerant evaporated in the first adsorption heat exchanger (51) is sucked into the compressor (53) and compressed, and again ejected from the compressor (53).

In this manner, in the refrigerant circuit (50), the second adsorption heat exchanger (52) operates as the condenser, while the first adsorption heat exchanger (51) operates as the evaporator. In the second adsorption heat exchanger (52), the adsorbent on the surfaces of the fins (57) is heated by the refrigerant in the heat transfer pipe (58), while moisture released from the heated adsorbent is provided to the second air. On the other hand, in the first adsorption heat exchanger (51), moisture in the first air is adsorbed by the adsorbent on the surfaces of the fins (57), and the generated adsorption heat is absorbed by the refrigerant in the heat transfer pipe (58).

Then, if during the dehumidifying operation, the first air dehumidified by the first adsorption heat exchanger (51) is supplied to the room, while the moisture released from the second adsorption heat exchanger (52) is ejected outdoors together with the second air. On the other hand, if during the humidifying operation, the second air humidified by the second adsorption heat exchanger (52) is supplied to the room, and the first air deprived of moisture in the first adsorption heat exchanger (51) is ejected outdoors.

<Operation of the Air Conditioner>

In the air conditioner (20) of the present embodiment, the air cooling and the heating operation are performed.

As shown in FIG. 4(A), in the air cooling of the air conditioner (20), the four-way selector valve (64) of the refrigerant circuit (60) is set in the first condition. When the compressor (63) is operated, the refrigerant circulates in the refrigerant circuit (50). Specifically, the refrigerant ejected from the compressor (63) releases heat in the outdoor heat exchanger (61) to be condensed. The refrigerant condensed in the outdoor heat exchanger (61) is depressurized when passing through the motorized expansion valve (65), thereafter absorbing heat in the room heat exchanger (62) to be evaporated. The refrigerant evaporated in the room heat exchanger (62) is sucked into the compressor (63) and compressed, and again ejected from the compressor (63).

In this manner, in the refrigerant circuit (60), the outdoor heat exchanger (61) operates as the condenser, and the room heat exchanger (62) operates as the evaporator. On the other hand, air sucked from the room into the air conditioner (20) passes through the room heat exchanger (62) which operates as the evaporator. This air, after being refrigerated by the room heat exchanger (62), is supplied to the room.

On the other hand, in the heating operation of the air conditioner (20), as shown in FIG. 4(B), the four-way selector valve (64) of the refrigerant circuit (60) is set in the second condition. When the compressor (63) is operated, the refrigerant circulates in the refrigerant circuit (60). Specifically, the refrigerant ejected from the compressor (63) releases heat in the room heat exchanger (62) to be condensed. The refrigerant condensed in the room heat exchanger (62) is depressurized when passing through the motorized expansion valve (65), thereafter absorbing heat in the outdoor heat exchanger (61) to be evaporated. The refrigerant evaporated in the outdoor heat exchanger (61) is sucked into the compressor (63) and compressed, and again ejected from the compressor (63).

In this manner, in the refrigerant circuit (60), the outdoor heat exchanger (61) operates as the evaporator, and the room heat exchanger (62) operates as the condenser. On the other hand, air sucked from the room into the air conditioner (20) passes through the room heat exchanger (62), which operates as the condenser. This air, after being heated by the room heat exchanger (62), is supplied to the room.

<Control Operation of the Air Conditioning System>

In the air conditioning system (1) of this embodiment, the humidity set value Rs and the temperature set value Ts are inputted in the controller (30), so that the humidity adjustment section (41) and the air conditioning control section (42) control operation of the humidity controller (10) and operation of the air conditioner (20), respectively, on the basis of the humidity set value Rs and the temperature set value Ts. Description will be made below of the operation of the air conditioning system (1) of this embodiment in the case of increasing the room temperature while humidifying the room when the room humidity is lower than the humidity set value Rs and the room temperature is lower than the temperature set value Ts.

In the humidity controller (10), the humidity adjustment section (41) receives the temperature set value Ts (25° C.) and the humidity set value Rs (e.g., relative humidity 60%) inputted into the controller (30). Further, the humidity adjustment section (41) receives the measured value To of the outdoor temperature sensor, the measured value of the room temperature sensor, the measured value of the outdoor humidity sensor, and the measured value of the room humidity sensor. Further, the humidity adjustment section (41) transmits the received measured value To of the outdoor temperature sensor to the air conditioning control section (42).

The humidity adjustment section (41) first determines on the humidifying operation as the operating mode of the humidity controller (10) from the measured value of the room humidity sensor and the humidity set value Rs. Then, from the temperature set value Ts and the humidity set value Rs, the humidity adjustment section (41) calculates in the arithmetic section (33), as the target absolute humidity, the absolute humidity which becomes the humidity set value Rs at the temperature set value Ts. Further, the arithmetic section (33) calculates the absolute humidity of the outdoor air (OA) from the measured value To of the outdoor temperature sensor and the measured value of the outdoor humidity sensor, and calculates the absolute humidity of the room air (RA) from the measured value of the room temperature sensor and the measured value of the room humidity sensor. Moreover, on the basis of the absolute humidities of the outdoor air (OA) and the room air (RA) as well as the target absolute humidity mentioned above, the humidity adjustment section (41) controls the humidifying capacity of the humidity controller (10) so that the absolute humidity of the room may come very close to the target absolute humidity. The humidifying capacity of the humidity controller (10) is adjusted, for example, by altering the operation frequency of the compressor (63) and changing the circulating amount of the refrigerant. It should be noted that in controlling the humidity controller (10), the measured value of the room temperature sensor is also taken into consideration. When the room temperature reaches the temperature set value Ts, the humidity adjustment section (41) either reduces the humidity adjustment capacity of the humidity controller (10) or suspends the humidity controller (10) as necessary.

On the other hand, in the air conditioner (20), the air conditioning control section (42) receives the temperature set value Ts, which is inputted into the controller (30), the measured value of the suction temperature sensor, and the measured value To of the outdoor temperature sensor transmitted from the humidity controller (10). Moreover, using the measured value To of the outdoor temperature sensor and the temperature set value Ts, which have been received, the air conditioning control section (42) determines whether to start the air conditioner (20) simultaneously with the humidity controller (10) or to start the air conditioner (20) after the lapse of a pre-set time (e.g., 15 minutes) from the start of the humidity controller (10).

Specifically, in the case where the measured value To of the outdoor temperature sensor is more than (the temperature set value Ts−A) and less than (the temperature set value Ts+B), that is, (Ts−A≦To≦Ts+B), then the air conditioning control section (42) starts the air conditioner (20) after the lapse of a pre-set time from the start of the humidity controller (10), while, in all other cases, the air conditioner (20) and the humidity controller (10) are simultaneously started. It is noted that in the foregoing, the values of A and B are pre-set integers over 0, which are set as, for example, A=5 and B=0.

When the measured value To of the outdoor temperature sensor is within the above range, that is, when there is a relatively small difference between the temperature set value Ts and the measured value To of the outdoor temperature sensor, then the temperature of the ejected air of the humidity controller (10) becomes relatively high such that simultaneously starting the air conditioner (10) may entail a risk where the room temperature reaches the temperature set value Ts while humidity adjustment of air in the humidity controller (10) is insufficient. Therefore, the air conditioning control section (42) starts the humidity controller (10) first. When the measured value To of the outdoor temperature sensor is not within the above-described range, that is, when there is a relatively small difference between the set temperature Ts and the measured value To of the outdoor temperature sensor, then the air conditioning control section (42) starts the air conditioner (20) and the humidity controller (10) simultaneously.

In the above-mentioned determination, when the air conditioning control section (42) determines to start the air conditioner (20) and the humidity controller (10) simultaneously, the heating operation of the air conditioner (20) is started. Control of the heating capacity of the air conditioner (20) is performed, for example, as the air conditioning control section (42) adjusts the operation frequency of the compressor (63).

Figure 5:
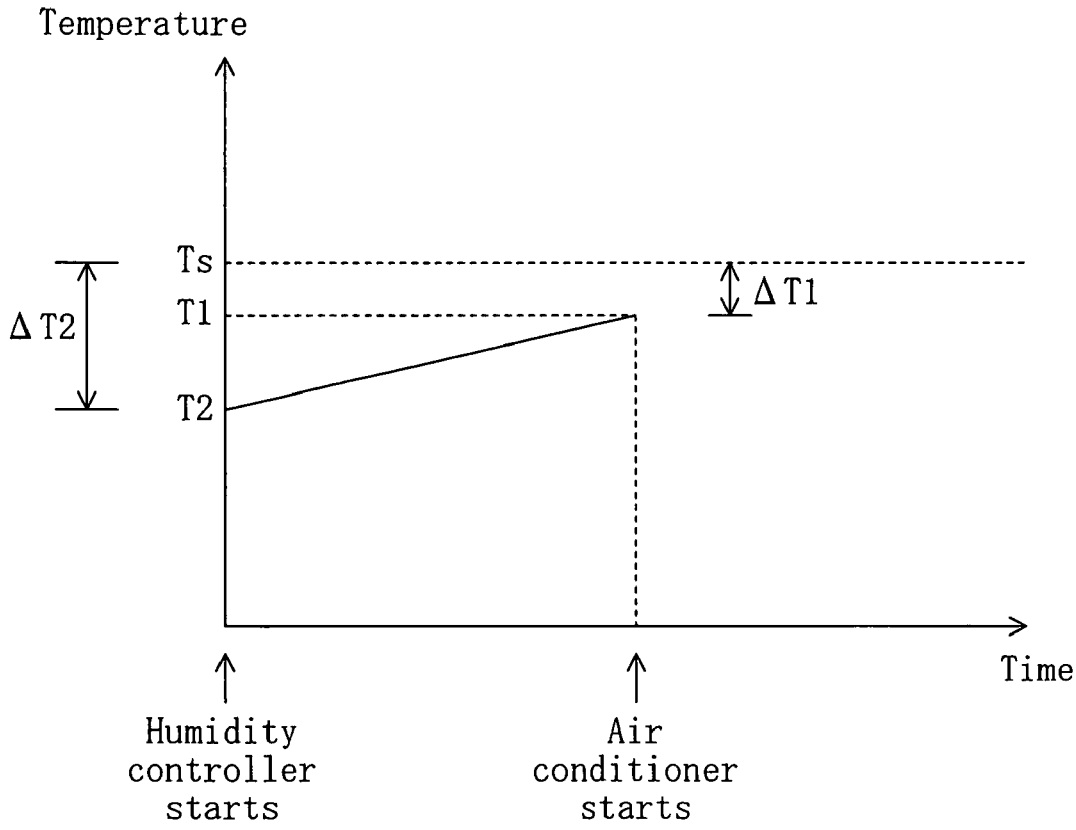
FIG. 5 is a diagram showing the measured value of a room temperature sensor from the start of the humidity controller of the embodiment to the start of the air conditioner.

Further, in the above-mentioned determination, when the air conditioning control section (42) determines to start the air conditioner (20) after the lapse of a pre-set time from the start of the humidity controller (10), the decision-making action is performed to determine the operating mode of the air conditioner (20) at the time of starting the air conditioner (20). Specifically, the decision-making action is performed with the following formulas by using a difference ΔT1 (=Ts−T1) between the temperature set value Ts at the time of starting the air conditioner (20) and the measured value T1 of the suction temperature sensor and a difference ΔT2 (=Ts−T2) between the temperature set value Ts at the time of starting the humidity controller (10) and the measured value T2 of the suction temperature sensor (see FIG. 5). When formula 1 is satisfied, the air conditioning control section (42) determines on the heating operation as the operating mode, while the air cooling is determined when formula 2 is satisfied.

$$(\Delta T1-\Delta T2)\times 1 \text{ and } 5+\Delta T1 \geqq 2 \qquad \text{Formula 1}$$

$$(\Delta T1-\Delta T2)\times 1 \text{ and } 5+\Delta T1 \geqq -2 \qquad \text{Formula 2}$$

The foregoing formulas for taking the decision-making action are presented only for exemplary purposes, and other relation formulas may be used in the decision-making action.

The foregoing formulas are based on a changed value (ΔT1−ΔT2) of the difference between the temperature set value Ts from the starting time of the humidity controller (10) to the starting time of the air conditioner (20) and the measured value of the room temperature sensor. For example, when the difference between the outdoor air temperature and the temperature set value Ts is small, the temperature of the ejected air of the humidity controller (10) at the time of the humidifying operation becomes relatively high, so that as operation of the humidity controller (10) proceeds, the room may be heated to increase the changed value. In such case, it is determined that there is an excessive increase in the room temperature through operation of the humidity controller (10), and thus the operating mode is switched to the air cooling. On the other hand, when the changed value is small, it is determined that operation of the humidity controller (10) alone may not be able to increase the room temperature sufficiently, and thus the operating mode is switched to the heating operation. When both formula 1 and formula 2 are not satisfied, the air conditioning control section (42) does not start the air conditioner (20), whereafter the above-mentioned decision-making action is made at pre-set intervals (e.g., 10 minutes).

Description will now be made of the operation of the air conditioning control section (42) through the thermostat-off status of the air conditioner (20) to restarting thereof. When the measured value of the suction temperature sensor exceeds the temperature set value Ts during the heating operation, the air conditioning control section (42) sets the air conditioner (20) at the thermostat-off status where air temperature conditioning is suspended. Upon setting the thermostat-off status, the compressor (63) of the air conditioner (20) stops. When the first condition is established in the thermostat-off status, the air conditioning section (42) determines the operating mode of the air conditioner (20). Further, when the second condition is established, the air conditioning section (42) restarts the air conditioner (20) in a different operating mode from the operating mode immediately before the thermostat-off status, that is, in the air cooling.

Specifically, the first condition is a condition where a pre-set time (e.g., 15 minutes) has elapsed from the start of the thermostat-off status. When the first condition is established, the air conditioning section (42) determines the operating mode of the air conditioner (20) on the basis of the temperature set value Ts and the measured value of the suction temperature sensor. Determination of the operating mode is carried out using the same formulas (that is, formula 1 and formula 2) as in the foregoing decision-making action.

The second condition is a condition where, in the thermostat-off status, the difference between the temperature set value Ts and the measured value of the suction temperature sensor increases while a pre-set time (e.g., 1 minute) elapses from a certain point in time. When the second condition is established, the air conditioning control section (42) causes the air conditioner (20) to perform the air cooling to avoid a situation where the room temperature moves away from the temperature setting following the humidifying operation of the humidity controller (10).

Next, operation of the air conditioning system (1) of this embodiment will be briefly described, in the case of decreasing the room temperature while dehumidifying the room under the conditions where the room humidity is higher than the humidity set value Rs and the room temperature is higher than the temperature set value Ts.

The humidity adjustment section (41) first determines on the dehumidifying operation as the operating mode of the humidity controller (10) from the measured value of the room temperature sensor and the humidity set value Rs. Next, the humidity adjustment section (41) calculates the target absolute humidity from the temperature set value Ts and the humidity set value Rs, and adjusts the dehumidifying capacity of the humidity controller (10) so that the absolute humidity of the room may come very close to the target absolute humidity on the basis of the target absolute humidity and the absolute humidity of the outdoor air (OA) and the room air (RA). When the measured value of the room temperature sensor reaches the temperature set value Ts, the humidity adjustment section (41) reduces the humidity adjustment capacity of the humidity controller (10) or suspends the humidity controller (10) as necessary.

On the other hand, the air conditioning control section (42) starts the air conditioner (20) after the lapse of a pre-set time from the start of the humidity controller (10) when the measured value To of the outdoor temperature sensor is within a pre-set range in relation to the temperature set value Ts. When the measured value To is outside the pre-set range, the air conditioning control section (42) starts the air conditioner (20) simultaneously with the humidity controller (10), whereby the air conditioner (10) is caused to start the air cooling. Further, the air conditioning control section (42) performs the decision-making action to determine the operating mode of the air conditioner (20) on the basis of the temperature set value Ts and the measured value of the suction temperature sensor at the time of starring the air conditioner (20) after the lapse of a pre-set time from the start of the humidity controller (10). Furthermore, the air conditioning control section (42) determines the operating mode of the air conditioner (20) when a pre-set condition is established in the thermostat-off status. When the measured value of the suction temperature sensor falls below the temperature set value Ts during the air cooling, the air conditioning control section (42) sets the air conditioner (20) at the thermostat-off status where air conditioning temperature control is suspended.

Thus, when the air conditioning system (1) is started, the humidity controller (10) performs humidity adjustment so as to reach the humidity set value Rs, where there is a case where the room is heated following the dehumidifying operation or the room is cooled following the dehumidifying operation. In view of this, operation of the air conditioner (20) is controlled through the outdoor air humidity and the room air temperature. This enables the room humidity to be adjusted to the humidity set value Rs and the room temperature to be adjusted to the temperature set value Ts.

Effects of the Embodiment

In the above-mentioned embodiment, when the temperature To of the outdoor air is within a pre-set range, the humidity controller (10) is started before the air conditioner (20) to secure time for adjusting air humidity in the humidity controller (10). This enables the air conditioner (20) to start while the room humidity is very close to the humidity set value Rs. If adjustment of air humidity in the humidity controller (10) and control of air temperature in the air conditioner (20) are simultaneously started, there may be cases where the room temperature may reach the set temperature in a relatively short time, wherefore the operation of the humidity controller (10) may be limited even despite insufficient humidity adjustment. However, in the present invention, when the temperature To of the outdoor air is within a pre-set range, adjustment of air humidity is performed in the humidity controller (10) during the time until the air conditioner (20) is started, thus enabling the room humidity to come very close to the humidity set value Rs. Accordingly, the comfort levels of the person in the room space improve.

Further, in the above-mentioned embodiment, by using the changed value which is the difference between the temperature set value Ts and the measured value of the room temperature from the start of the humidity controller (10) to the start of the air conditioner (20) for the above decision-making action, the operating mode of the air conditioner (20) is determined in consideration of room temperature changes due to the operation of the humidity controller (10). This makes it possible to determine accurately whether to cool or to heat the room when starting the air conditioner (20), thus properly determining the operating mode of the air conditioner (20).

Further, according to the above-mentioned embodiment, in the air conditioning system (1), the humidity controller (10) has the capacity to change the room temperature, and thus there is a case where even if the air conditioner (20) is in the thermostat-off status, the room temperature may be held with a relatively large difference with the temperature set value. Ts. In view of this, after the lapse of a pre-set time from the start of the thermostat-off status, the above-mentioned control means (41 and 42) determine the operating mode of the air conditioner (20). Then, the operating mode of the air conditioner (20) is properly determined in such a way that the room temperature comes very close to the temperature set value Ts. This elongates the time for the room temperature to be in the vicinity of the set value Ts, leading to improvement in the comfort levels of the person in the room space.

Further, according to the above-mentioned embodiment, in the air conditioning system (1), there is a case where even if the air conditioner (20) is in the thermostat-off status, the room temperature may move away from the temperature set value Ts. In view of this, upon detecting such condition, the air conditioning system (1) causes the air conditioner (20) to operate on an operating mode different from the operating mode immediately before the thermostat-off status. This causes the room temperature to move very close to the temperature set value Ts, leading to improvement in the comfort levels of the person in the room space.

Other Embodiments

In the above-mentioned embodiment, the air conditioning control section (42) which received the measured value of the outdoor temperature sensor determines whether to delay the start of the air conditioner (20) from the start of the humidity controller (10). It is possible that the humidity adjustment section (41) in which the outdoor temperature sensor is provided may carry out this determination, and a result of the determination may be transmitted to the air conditioning control section (42).

Further, while in the above-mentioned embodiment, an input section of the temperature set value Ts and the humidity set value Rs is provided in the controller (30), the input section may be provided, for example, in the humidity adjustment section (41) of the humidity controller (10) or in the air conditioning control section (42) of the air conditioner (20).

Further, it is not always necessary for an operator to manually input the humidity set value Rs; a suitable humidity may be automatically determined by the humidity adjustment section (42) from an input set temperature Ts. In this case, the humidity which humans feel comfortable should be stored in advance in the humidity adjustment section (42) per temperature condition. For example, when the target temperature Ts is under 20 degrees, the humidity adjustment section (42) stores in advance a target humidity Rs of 55%; when the target temperature Ts is more than 22 degrees and less than 26 degrees, the humidity adjustment section (42) stores in advance a target humidity Rs of 50%; and when the target temperature Ts is more than 26 degrees and less than 45 degrees, the humidity adjustment section (42) stores in advance a target humidity Rs of 45%.

Further, in the above-mentioned embodiment, the humidity controller (10) may be constituted as follows. Modified examples of the humidity controller (10) will be described.

First Modified Example

As shown in FIG. 6, the humidity controller (10) of the first modified example is provided with a refrigerant circuit (100) and two adsorbing elements (111 and 112). The refrigerant circuit (100) is a closed circuit in which a compressor (101), a condenser (102), an expansion valve (103), and an evaporator (104) are connected by turns. When the refrigerant circuit (100) circulates a refrigerant, a steam compression freezing cycle is performed. This refrigerant circuit (100) constitutes heat source means. A first adsorbing element (111) and a second adsorbing element (112) have adsorbents such as zeolite, each constituting an adsorption member. Further, each adsorbing element (111 and 112) is formed of numerous air paths, and air when passing through these paths comes in contact with the adsorbent.

Figure 6A:
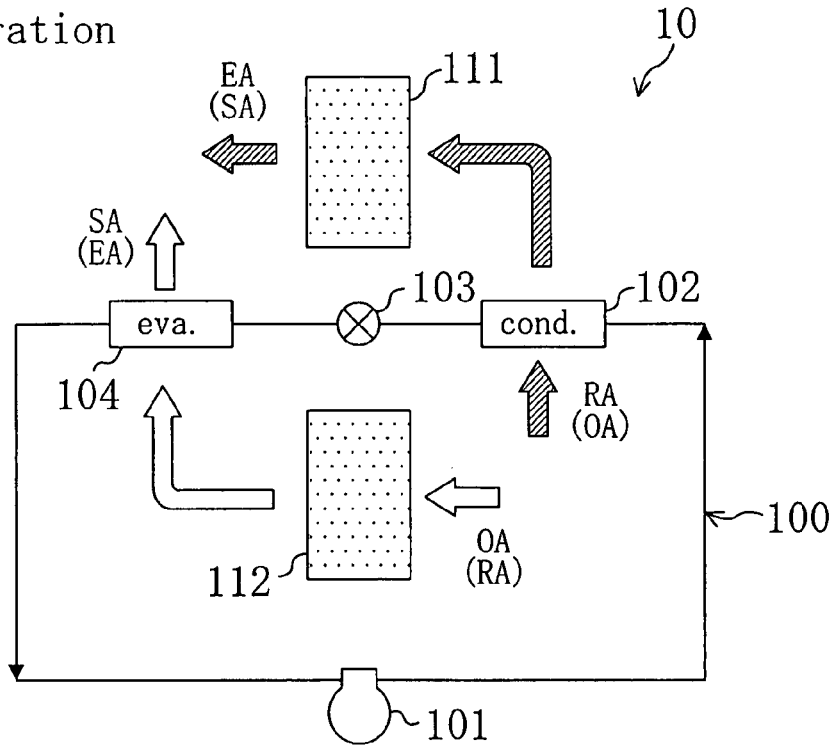
FIG. 6 is a schematic block diagram of a humidity controller of a first modified example of another embodiment; (A) shows operation during a first operation, and (B) shows operation during a second operation.
Figure 6B:
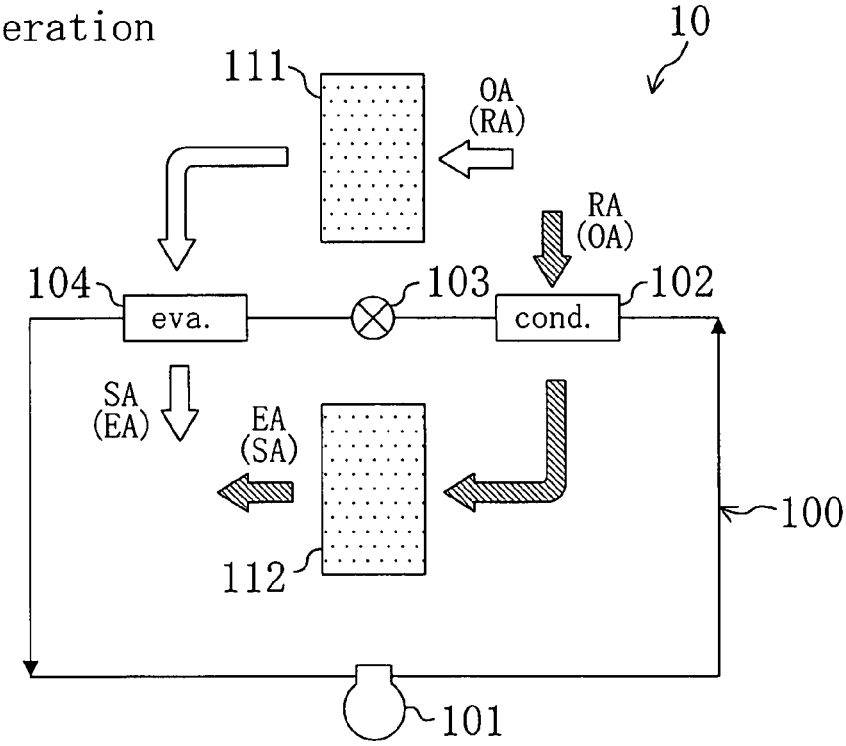

This humidity controller (10) repeats the first operation and the second operation. As shown in FIG. 6(A), the humidity controller (10) in the first operation supplies air heated by the condenser (102) to the first adsorbing element (111) to regenerate the adsorbent, while refrigerating in the evaporator (104) the air which has been deprived of moisture by the second adsorbing element (112). Further, as shown in FIG. 6(B), the humidity controller (10) in the second operation supplies air heated by the condenser (102) to the second adsorbing element (112) to regenerate the adsorbent, while refrigerating in the evaporator (104) the air which has been deprived of moisture by the first adsorbing element (111). The humidity controller (10) performs, through switching, the dehumidifying operation of supplying to the room the air which is dehumidified while passing through the adsorbing elements (111 and 112) and the humidifying operation of supplying to the room the air which is humidified while passing through the adsorbents (111 and 112).

Second Modified Example

Figure 7:
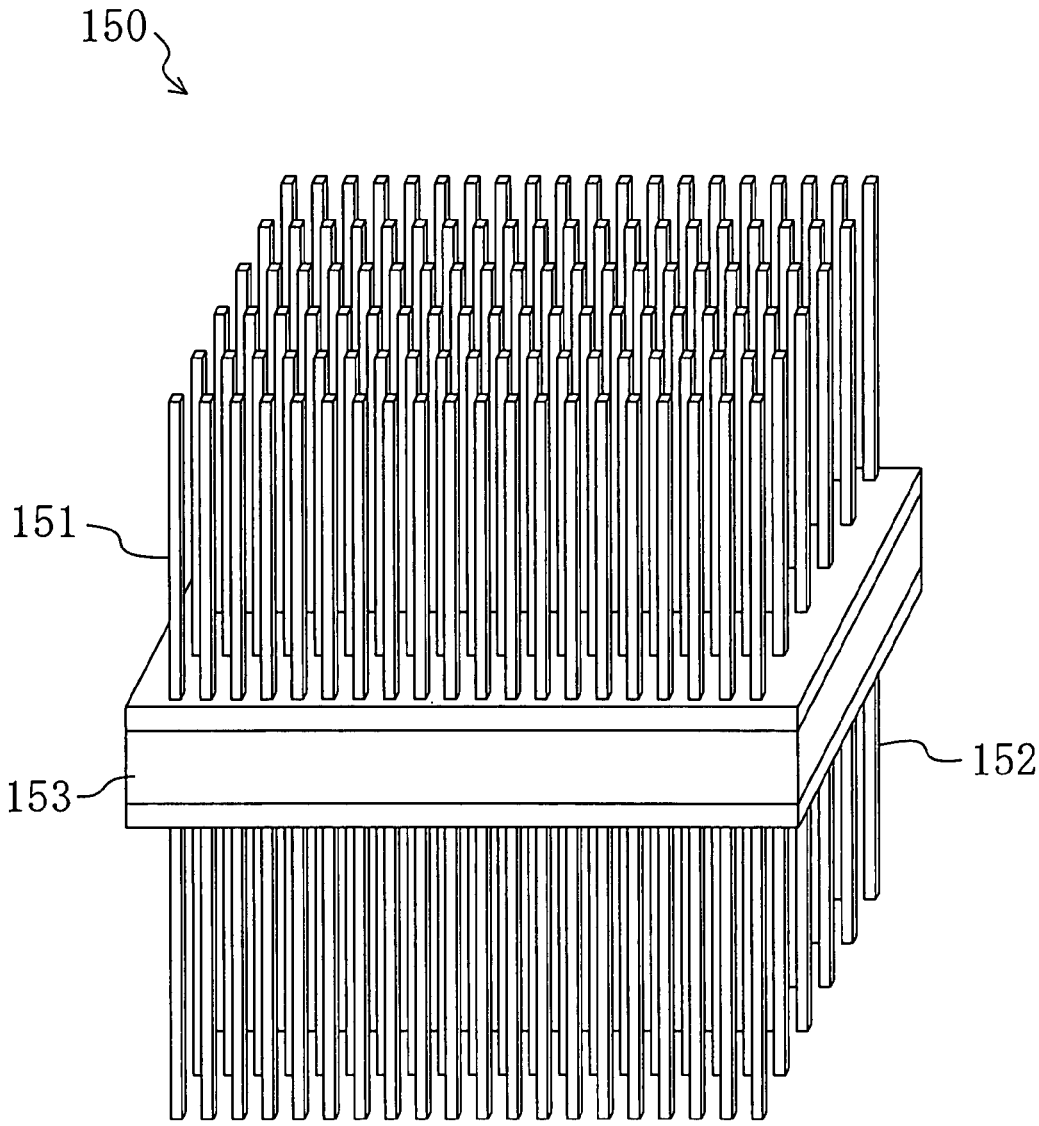
FIG. 7 is a schematic perspective view of a humidity adjusting unit in a second modified example of another embodiment.

As shown in FIG. 7, the humidity controller (10) of the second modified example is provided with a humidity adjustment unit (150). This humidity adjustment unit (150) is provided with a Peltier element (153) and a pair of adsorbing fins (151 and 152). The adsorbing fins (151 and 152) are each composed of a so-called heat sink whose surface supports the adsorbent such as zeolite. The adsorbing fins (151 and 152) constitute adsorbing members. On one surface of the Peltier element (153) is connected a first adsorbing fin (151), while on the other surface thereof is connected a second adsorbing fin (152). When a direct current is run on the Peltier element (153), one of the two adsorbing fins (151 and 152) becomes a heat adsorption side while the other becomes a heat release side. The Peltier element (153) constitutes heat source means.

The humidity controller (10) repeats the first operation and the second operation. The humidity adjustment unit (150) in the first operation regenerates the adsorbent of the first adsorbing fin (151), which became the heat release side, and humidifies air, while causing the adsorbent of the second adsorbing fin (152), which became the heat adsorption side, to adsorb moisture and dehumidify air. Further, the humidity adjustment unit (150) in the first operation regenerates the adsorbent of the second adsorbing fin (152), which became the heat release side, and humidifies air, while causing the adsorbent of the first adsorbing fin (151), which became the heat adsorption side, to adsorb moisture and dehumidify air. The humidity controller (10) performs, through switching, the dehumidifying operation of supplying to the room the air which is dehumidified while passing through the humidity adjustment unit (150) and the humidifying operation of supplying to the room the air which is humidified while passing through the humidity adjustment unit (150).

The embodiments described above represent intrinsically desirable exemplification, and is in no way intended to limit the present invention, its applications or the range of its use.

INDUSTRIAL APPLICABILITY

As described in the foregoing, the present invention is useful for air conditioning systems equipped with humidity controllers and air conditioners to cover the same room space.

The invention claimed is:

1. An air conditioning system having a humidity controller (10) for adjusting humidity of outdoor air for supply thereof into a room and an air conditioner (20) for supplying into a room air whose temperature has been controlled, wherein:

the humidity controller (10) comprises: adsorbing members (51 and 52) by which an adsorbent is supported; and heating source means (50) for at least heating the adsorbent of the adsorbing members (51 and 52), the humidity controller (10) adjusting the humidity of the outdoor air in contact with the adsorbent of the adsorbing members (51 and 52); and the air conditioning system comprises controlling means (41 and 42) for, when a temperature To of the outdoor air is within a pre-set range at the time of starting the air conditioning system (1), causing the air conditioner (20) to start air temperature control after a lapse of a pre-set time since the humidity controller (10) started adjusting air humidity.

2. An air conditioning system having a humidity controller (10) for adjusting humidity of outdoor air for supply thereof into a room and an air conditioner (20) for supplying into a room air whose temperature is controlled, wherein:

the humidity controller (10) comprises a refrigerant circuit (50) to which adsorbing heat exchangers (51 and 52) with an adsorbent supported thereon are connected, thus carrying out a refrigerating cycle, the humidity controller (10) adjusting the humidity of the outdoor air in contact with the adsorbent by heating or refrigerating the adsorbent of the adsorbing heat exchangers (51 and 52) through the refrigerant of the refrigerant circuit (50); and the air conditioning system comprises controlling means (41 and 42) for, when a temperature To of the outdoor air is within a pre-set range at the time of starting the air conditioning system (1), causing the air conditioner (20) to start air temperature control after a lapse of a pre-set time since the humidity controller (10) started adjusting air humidity.

3. The air conditioning system according to claim 1 or 2, wherein:

the air conditioner (20) is capable of selecting between a cooling operating mode for cooling the room and a heating operating mode for heating the room;

at the time of causing the air conditioner (20) to start air temperature control after the lapse of the pre-set time since the humidity controller (10) started air humidity adjustment, the control means (41 and 42) perform a decision-making action to determine an operating mode of the air conditioner (20) on the basis of a set value Ts and a measured value of the room temperature.

4. The air conditioning system according to claim 3, wherein in the decision-making action, the control means (41 and 42) determine the operating mode of the air conditioner (20) on the basis of a changed value of a difference between the set value Ts and the measured value of the room temperature from the start of the air humidity adjustment by the humidity controller (10) to the start of the air temperature control by the air conditioner (20).

5. The air conditioning system according to claim 3, wherein the control means (41 and 42) are configured to: set up the air conditioner (20) at a thermostat-off status to stop the air temperature control by cases where the measured value of the room temperature falls below the set value Ts during the air cooling and where the measured value of the room temperature increases above the set value Ts during the heating operation; and to, after the lapse of a pre-set time from the start of the thermostat-off status, determine the operating mode of the air conditioner (20) on the basis of the set value Ts and the measured value of the room temperature.

6. The air conditioning system according to claim 3, wherein the control means (41 and 42) are configured to: set up the air conditioner (20) in a thermostat-off status to stop the air temperature control in cases where the measured value of the room temperature falls below the set value Ts during the air cooling and where the measured value of the room temperature increase above the set value Ts during the heating operation; and to cause, if the difference between the set value Ts and the measured value of the room temperature should increase during a period of time from a certain point in time in the thermostat-off status until a lapse of a pre-set time, the air conditioner (20) to operate on an operating mode different from the operating mode immediately before entering the thermostat-off status.

* * * * *